US005156255A

United States Patent [19]

Laudua et al.

[11] Patent Number: 5,156,255

[45] Date of Patent: Oct. 20, 1992

[54] TRANSPORTING DEVICE FOR FOUNDRY CORES AND MOLDS

[75] Inventors: Werner Laudua, Mannheim; Rainer Rommel, Brühl; Jürgen Müller, Mannheim, all of Fed. Rep. of Germany

[73] Assignee: Adolf Hottinger Maschinenbau GmbH, Mannheim, Fed. Rep. of Germany

[21] Appl. No.: 761,818

[22] PCT Filed: Feb. 27, 1990

[86] PCT No.: PCT/DE90/00130

§ 371 Date: Sep. 20, 1991

§ 102(e) Date: Sep. 20, 1991

[87] PCT Pub. No.: WO90/11152

PCT Pub. Date: Oct. 4, 1990

[30] Foreign Application Priority Data

Mar. 20, 1989 [DE] Fed. Rep. of Germany ..... 3909102

[51] Int. Cl.[5] ..... B65G 25/00

[52] U.S. Cl. ..... 198/470.1; 198/803.8

[58] Field of Search ..... 198/470.1, 803.8, 803.12; 294/98.1

[56] References Cited

U.S. PATENT DOCUMENTS

| | | | |
|---|---|---|---|
| 3,945,486 | 3/1976 | Cooper | 294/98.1 X |
| 4,480,865 | 11/1984 | Chamdru | 294/87.1 |
| 4,678,425 | 7/1987 | Gibbemeyer | 294/98.1 X |

FOREIGN PATENT DOCUMENTS

| | | |
|---|---|---|
| 0063966 | 11/1982 | European Pat. Off. . |
| 0251055 | 1/1988 | European Pat. Off. . |
| 2409851 | 9/1974 | Fed. Rep. of Germany . |
| 2104999 | 4/1972 | France . |
| 2416856 | 9/1979 | France . |

*Primary Examiner*—Joseph E. Valenza
*Assistant Examiner*—Chery L. Gastineau
*Attorney, Agent, or Firm*—Bell, Seltzer, Park & Gibson

[57] ABSTRACT

The subject matter of the present invention is a continuously operating transporting device, in particular for treating foundry cores and molds, with an endlessly revolving conveyor belt and uniformly spaced-apart insertable grippers which are supplied and controlled with air via an annular line with connecting pieces, which is coupled to the conveyor belt, with the insertable grippers cooperating synchronously with a rotating distributor arranged on a drive shaft with spring-mounted connecting pieces. With the aid of the apparatus of the present invention, it is possible to treat or machine individual or interconnected foundry cores and molds in a fully automated and continuous operation in line with the production.

2 Claims, 5 Drawing Sheets

6
ABC
2
1
1
3
12
7
C
A
A
A
C
B
A
5
11

TRANSPORTING DEVICE FOR FOUNDRY CORES AND MOLDS

The present invention relates to a transporting device for casting cores and molds.

In the foundry practice, especially in the production of molded castings, cores or molds are manufactured separately, manually combined and connected, and subsequently pushed individually into a blacking device which mechanically strengthens the cores. This involves a too great requirement of floor space and has furthermore only little retaining power.

It is the object of the present invention to blacken or otherwise treat or process individual or interconnected foundry cores, in the present case bolted bottom-mounted cores or water-jacketed cores, in a fully automatic and continuous process in line with the manufacture of cores and molds.

The solution to this problem is disclosed by the technical teaching.

The apparatus of the present invention is integrated in a fully automatic, interlinked operating sequence, which extends in the present case from the manufacture of the cores, via their combination, connection, and blacking, to their depositing on a drying belt. The receiving and mounting on a drying belt for further treatment, in the present case on the blacking machine, occurs in the same space-saving intervals as are also present in the manufacture. The retaining power of the insertable grippers is infinitely variable.

The drawings, in conjunction with the subsequent description, illustrate an embodiment of the present invention.

Figure 1:
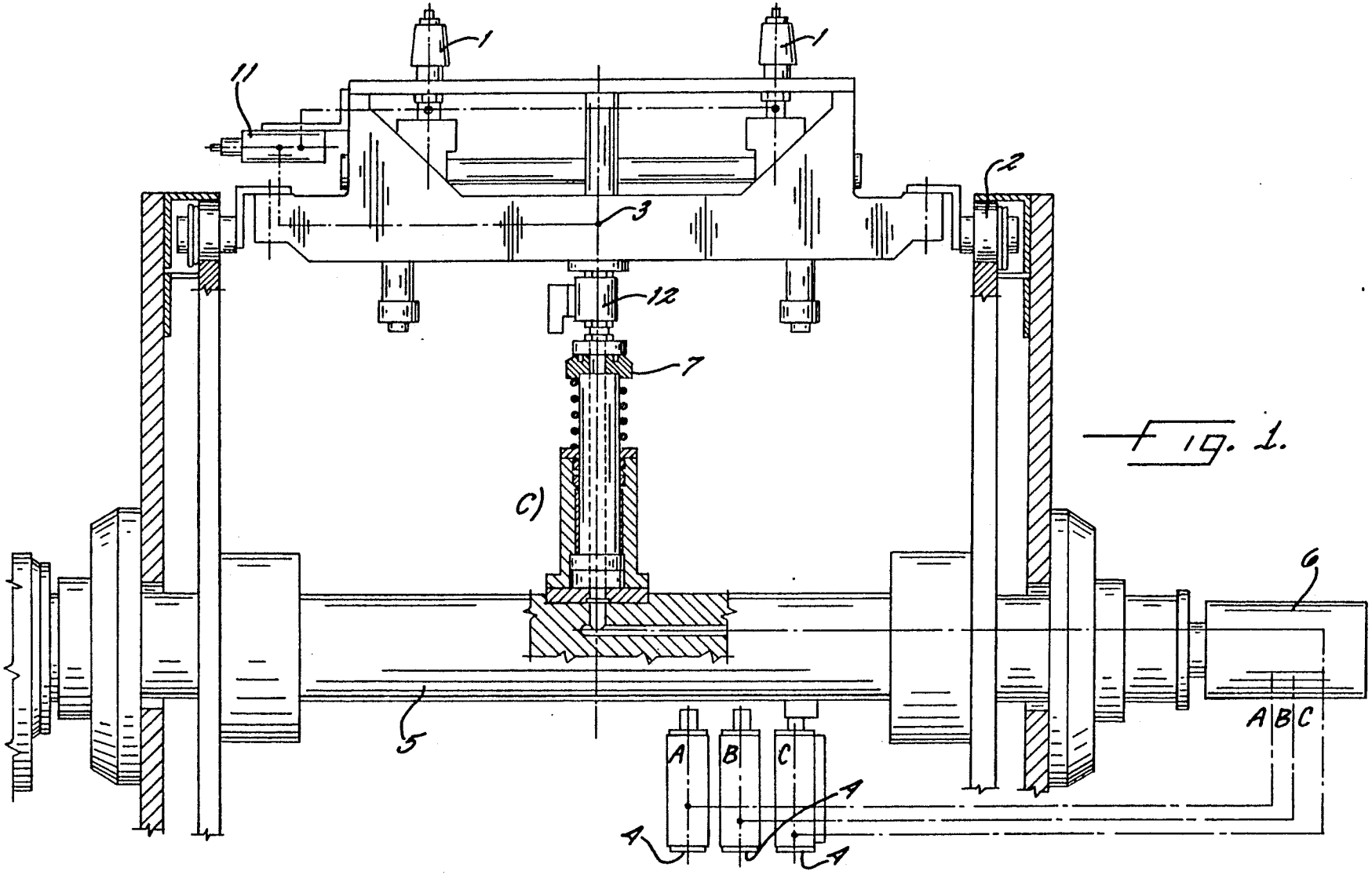
FIG. 1 is an overall sectional view of the apparatus in transverse direction along the line x—x of FIG. 3*a;*
Figure 2:
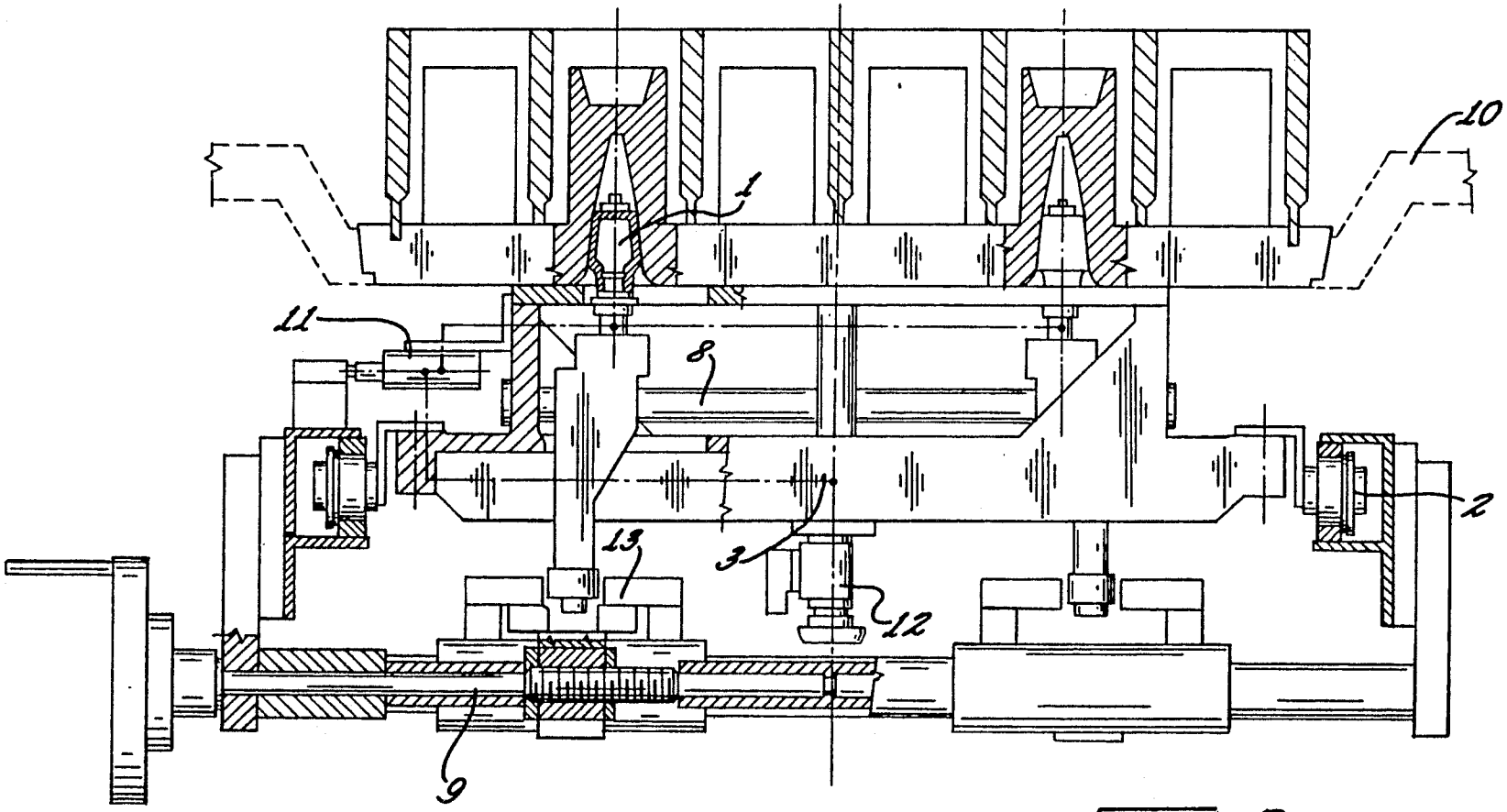
FIG. 2 is a sectional detail view in transverse direction along the line y—y of FIG. 3*a;*
Figure 3A:
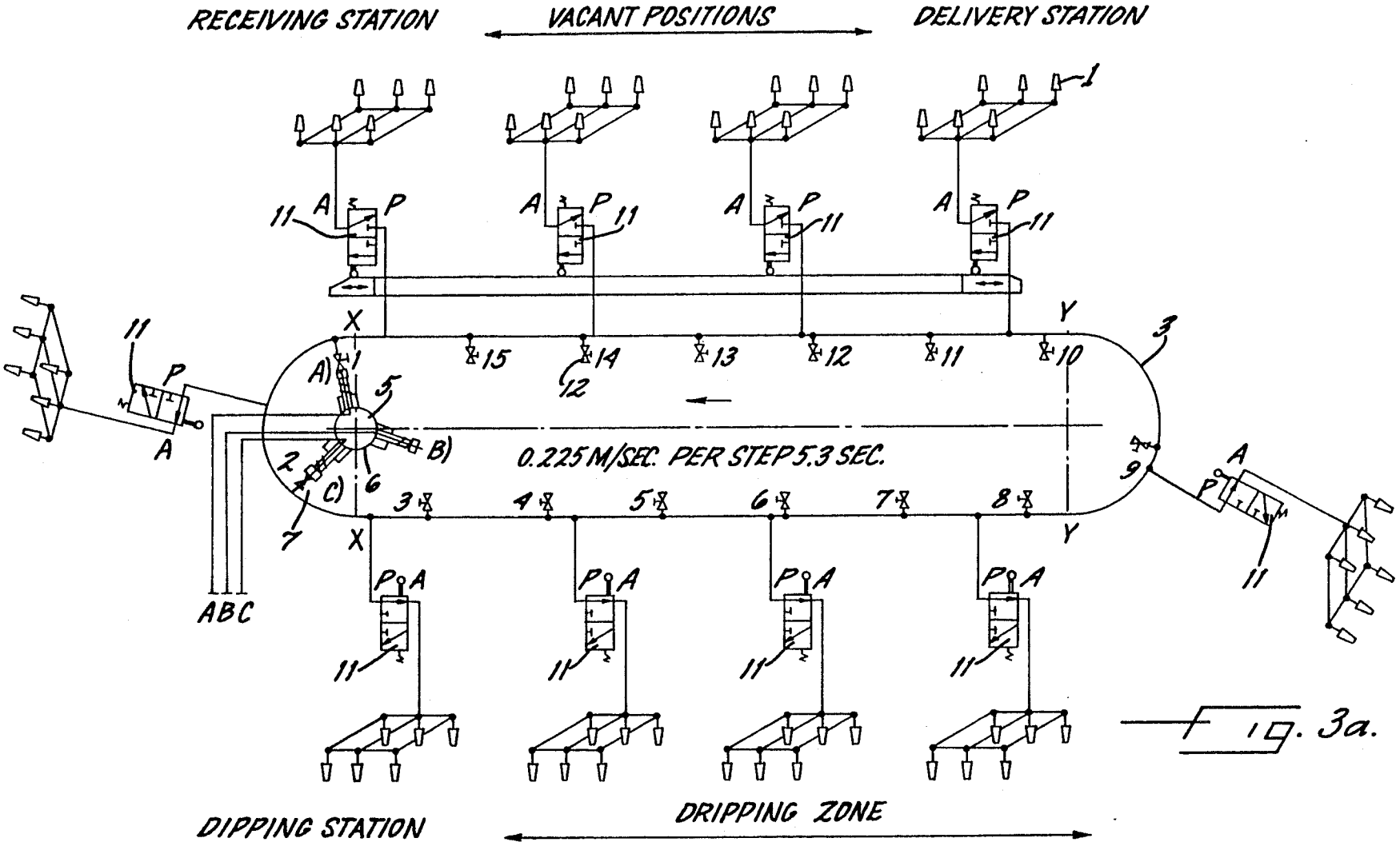
Figure 3B:
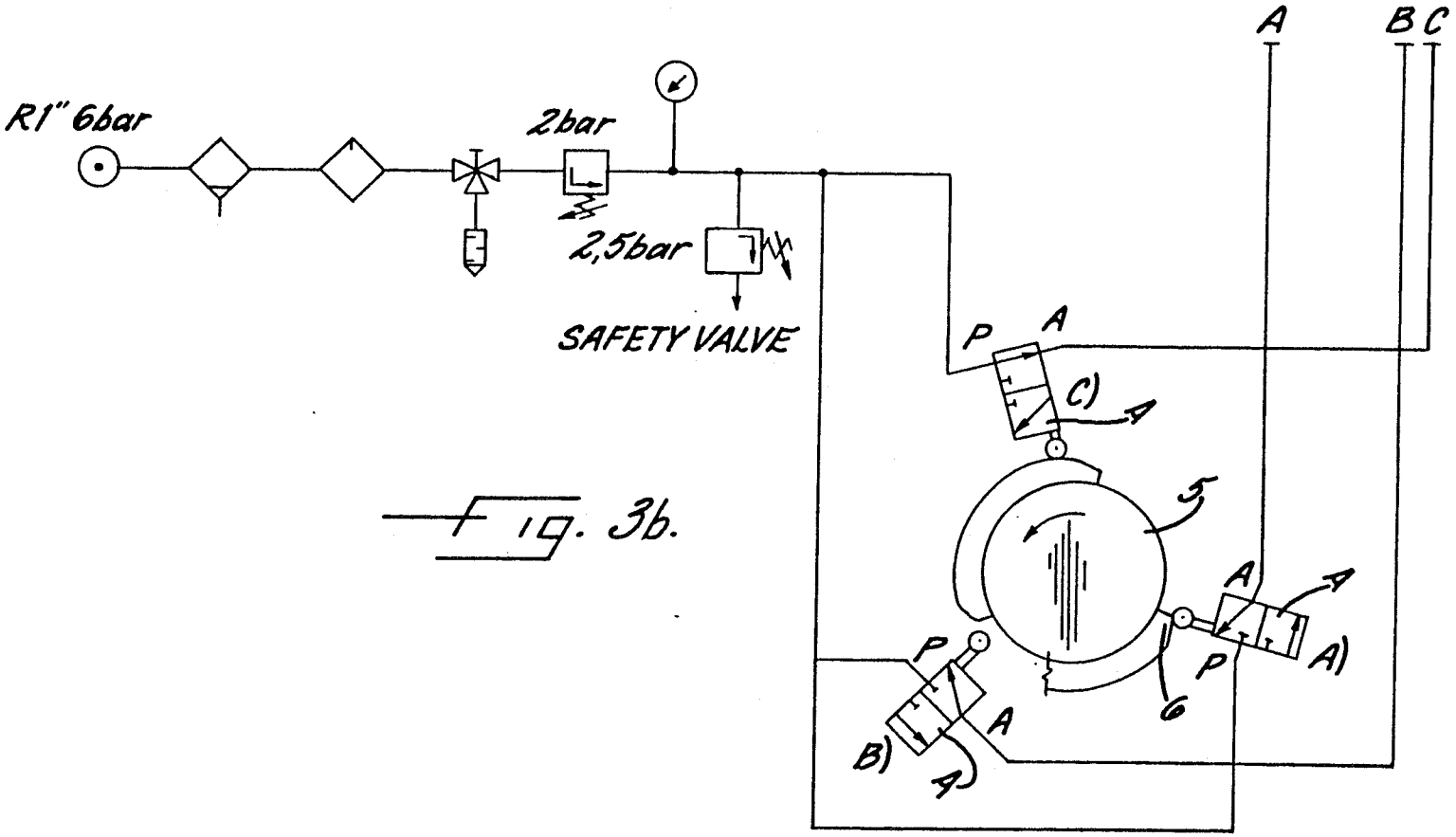
Figure 4:
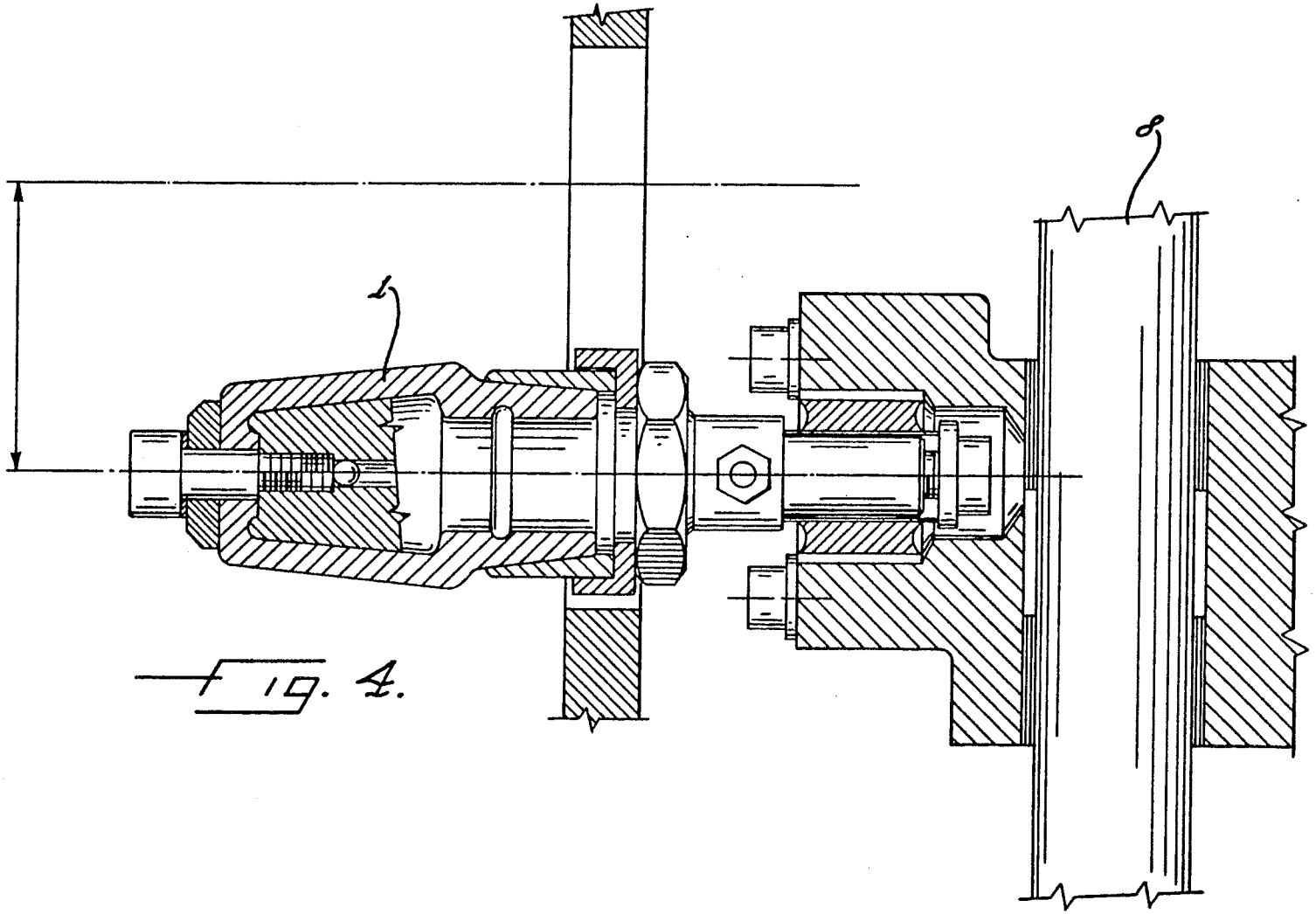

FIG. 3*a* is a schematic view of the air supply and control of the apparatus, whereas FIG. 3*b* is a partial sectional view of the drive shaft with the connection valves; and FIG. 4 is a sectional detail view of the insertable gripper.

The connected cores are brought by means of a gripping and transporting device 10 from the point of joining to the "receiving station" of the blacking machine and placed there on the insertable grippers 1 (three interconnected cores per one controlled-step movement) Subsequently, the conveyor belt 2 advances by one controlled step (1.200 meters). Via a cam valve 4 which engages on a contact edge immediately after the start, air is supplied through an annular conduit 3 to the insertable grippers 1 which press against the wall of the cores and thus hold the cores in position. After two controlled steps, the group of cores arrives in a downward hanging position at the "dipping station", where the cores are flooded by raising a tank filled with blackwash.

Along the further legs of the controlled-step operation, the excessive blackwash drips into a tank. At the "delivery station", the insertable grippers 1 are deflated upon the contact of a further cam valve 11 with a rail, so that the group of cores can be advanced by a further gripping and transporting device to the drying furnaces.

The distances between the insertable grippers 1 adjust automatically as the latter pass through a slot 13 which is set by a spindle 9 to the standardized distance.

The main air supply occurs via a rotating distributor 6 which is arranged on the drive shaft, and via spring-mounted connecting pieces 7. The connecting pieces 7 are actuated by contact pieces located on the drive shaft 5. In their respective position, the connecting pieces 7 are in contact with the counterpart arranged on the conveyor belt 2.

The idling connecting piece 7 is closed by the contact piece as the respective cam valve 4 engages.

The actuation of the fifteen contact pieces 12 (opening and closing) occurs mechanically by the movement of the conveyor belt 2 when the actuating levers engage, i.e., in the fixed-cycle operation only those two counterparts are opened, which are directly in contact with the spring-mounted connecting pieces 7.

That which is claimed is:

1. A continuously operating transporting device, in particular for treating foundry cores and molds, comprising an endlessly revolving conveyor belt with uniformly spaced-apart holding means or insertable grippers, characterized in that the insertable grippers (1) are adapted to be supplied with air via an annular line (3) with connecting valves (4), and are controllable, and that the insertable grippers (1) cooperate synchronously with a rotating distributor (6) on a drive shaft (5) with spring-mounted connecting pieces (7).

2. A transporting device according to claim 1, characterized in that the insertable grippers (1) are adjustable on a control shaft (8) via a spindle (9) synchronously with one another and at certain intervals.

* * * * *